US010035176B2

(12) United States Patent
Ito et al.

(10) Patent No.: US 10,035,176 B2
(45) Date of Patent: Jul. 31, 2018

(54) OPTICAL SORTING MACHINE

(75) Inventors: Takafumi Ito, Tokyo (JP); Masazumi Hara, Tokyo (JP); Tomoyuki Miyamoto, Tokyo (JP)

(73) Assignee: SATAKE CORPORATION, Tokyo (JP)

( * ) Notice: Subject to any disclaimer, the term of this patent is extended or adjusted under 35 U.S.C. 154(b) by 0 days.

(21) Appl. No.: 14/009,336

(22) PCT Filed: Mar. 22, 2012

(86) PCT No.: PCT/JP2012/001997

§ 371 (c)(1),
(2), (4) Date: Oct. 25, 2013

(87) PCT Pub. No.: WO2012/137433

PCT Pub. Date: Oct. 11, 2012

(65) Prior Publication Data

US 2014/0061103 A1 Mar. 6, 2014

(30) Foreign Application Priority Data

Apr. 4, 2011 (JP) ..... 2011-083057

(51) Int. Cl.
*B07C 5/342* (2006.01)
*B07C 5/36* (2006.01)

(52) U.S. Cl.
CPC ..... *B07C 5/342* (2013.01); *B07C 5/3425* (2013.01); *B07C 5/368* (2013.01); *B07C 5/366* (2013.01); *B07C 2501/0018* (2013.01)

(58) Field of Classification Search
CPC ..... B07C 5/3425; B07C 2501/0018
(Continued)

(56) References Cited

U.S. PATENT DOCUMENTS 5,733,592 A * 3/1998 Wettstein et al. ..... 426/416
2011/0284431 A1* 11/2011 Ito ..... B07C 5/3422 209/552
2015/0375270 A1* 12/2015 Ishizu ..... G01N 21/85 209/580

FOREIGN PATENT DOCUMENTS

CN 2740303 Y 11/2005
CN 201543603 U 8/2010
(Continued)

*Primary Examiner* — Howard J Sanders
(74) *Attorney, Agent, or Firm* — Orion Consulting, Ltd.; Joseph P. Farrar, Esq.

(57) ABSTRACT

The present invention intends to provide an optical sorting machine which can improve the collection rate of non-defective products without increasing the size of the machine. The optical sorting machine of the present invention includes a granular object feed unit including storage means that stores an object to be sorted, and transfer means that transfers the object to be sorted from the storage means; an optical sorting unit including optical detection means that detects an object to be sorted falling along a predetermined trajectory from an end portion of the transfer means, determination means that determines a type of the object to be sorted based on a detection signal from the optical detection means, an ejector that removes an object to be sorted determined as a specific type from the predetermined falling trajectory based on a determination result by the determination means, and a discharge hopper having a first discharge passage provided at a falling position of the object to be sorted falling along the predetermined trajectory, a second discharge passage provided at a falling position of the object to be sorted removed from the predetermined falling trajectory, and a third discharge passage formed between the first discharge passage and the second discharge passage; and conveyance means that conveys an object to be sorted discharged from the third discharge passage of the discharge
(Continued)

hopper in the optical sorting unit to the storage means of the granular object feed unit.

1 Claim, 6 Drawing Sheets

(58) Field of Classification Search
USPC ..... 209/576
See application file for complete search history.

(56) References Cited

FOREIGN PATENT DOCUMENTS

| | | | |
|---|---|---|---|
| JP | H02-157074 | A | 6/1990 |
| JP | H09-113456 | A | 5/1997 |
| JP | 2000-107703 | A | 4/2000 |

* cited by examiner

OPTICAL SORTING MACHINE

TECHNICAL FIELD

The present invention relates to an optical sorting machine which sorts granular objects such as grains and resin pellets based on color or the like.

BACKGROUND ART

There has been conventionally known an optical sorting machine which sorts a raw material of grains such as rice, wheat, pulses and nuts, resin pieces such as pellets and beads, fine articles such as medicines, ores and whitebait, or other granular objects into non-defective products and defective products, and removes foreign objects or the like mixed into the raw material.

This type of optical sorting machine illuminates granular objects falling along a predetermined trajectory from an end portion of a transfer passage, detects defective products or foreign objects included in the raw material upon receiving reflected light or the like from the granular objects, and removes the detected defective products or foreign objects, thereby sorting the granular objects.

While the optical sorting machine removes the defective products or the foreign objects by, for example, ejecting air to the granular objects falling along the predetermined trajectory, non-defective products existing near the defective products are caught and removed together.

Thus, there is known a method for sorting a raw material of granular objects into non-defective products and defective products in two stages by providing two sets of sorting units in parallel so as to improve the collection rate of non-defective products in the optical sorting machine (e.g., see Patent Literature 1).

FIG. 6 shows an explanatory view of a procedure for sorting non-defective products and defective products in the optical sorting machine described in Patent Literature 1.

In the optical sorting machine described in Patent Literature 1, a raw material of granular objects fed to a primary tank 121*a* is sorted into non-defective products and defective products in a primary sorting unit 103*a*. The granular objects sorted into the defective products in the primary sorting unit 103*a* are conveyed to a first elevator 105*a* through a passage 104*a*, conveyed to a secondary tank 121*b* by the first elevator 105*a*, and thereafter sorted into non-defective products and defective products in a secondary sorting unit 103*b*. The granular objects sorted into the non-defective products in the secondary sorting unit 103*b* are conveyed to a second elevator 105*b* through a passage 104*b*, conveyed to the primary tank 121*a* by the second elevator 105*b*, and sorted again into non-defective products and defective products in the primary sorting unit 103*a*.

In accordance with the optical sorting machine described in Patent Literature 1, it is possible to collect non-defective products caught in air for removing defective products in the primary sorting unit 103*a* and mixed into the defective products, and thereby improve the collection rate of non-defective products.

The optical sorting machine described in Patent Literature 1, however, has a problem that the machine is increased in size and cost since it is necessary to provide two sets of sorting units.

The optical sorting machine described in Patent Literature 1 also has a problem that, while many non-defective products caught in the air for removing defective products are mixed into the defective products conveyed to the secondary tank 121*b*, the secondary sorting unit cannot efficiently collect the non-defective products because its processing capacity is limited.

CITATION LIST

Patent Literature

[Patent Document 1] Japanese Patent Laid-Open No. 2000-107703

SUMMARY OF THE INVENTION

Technical Problem

It is thus an object of the present invention to provide an optical sorting machine which can improve the collection rate of non-defective products without increasing the size of the machine.

It is also an object of the present invention to provide an optical sorting machine which can efficiently collect non-defective products.

Solution to Problem

To achieve the above object, an optical sorting machine according to the present invention includes: a granular object feed unit including storage means that stores an object to be sorted, and transfer means that transfers the object to be sorted from the storage means; an optical sorting unit including optical detection means that detects an object to be sorted falling along a predetermined trajectory from an end portion of the transfer means, determination means that determines a type of the object to be sorted based on a detection signal from the optical detection means, an ejector that removes an object to be sorted determined as a specific type from the predetermined falling trajectory based on a determination result by the determination means, and a discharge hopper having a first discharge passage provided at a falling position of the object to be sorted falling along the predetermined trajectory, a second discharge passage provided at a falling position of the object to be sorted removed from the predetermined falling trajectory, and a third discharge passage formed between the first discharge passage and the second discharge passage; and conveyance means that conveys an object to be sorted discharged from the third discharge passage of the discharge hopper in the optical sorting unit to the storage means of the granular object feed unit.

In the optical sorting machine according to the present invention, the storage means may store a raw material fed from outside the sorting machine.

The optical sorting machine according to the present invention includes a plurality of granular object feed units as the granular object feed unit, a plurality of optical sorting units as the optical sorting unit, and a plurality of conveyance means as the conveyance means, the optical sorting machine further including: conveyance means that conveys an object to be sorted discharged from a first discharge passage or a second discharge passage of a discharge hopper in a first optical sorting unit to storage means of a second granular object feed unit; and conveyance means that conveys an object to be sorted discharged from a first discharge passage or a second discharge passage of a discharge hopper in a second optical sorting unit to storage means of a first granular object feed unit, wherein the storage means of the first granular object feed unit may store a raw material fed from outside the sorting machine.

In the optical sorting machine according to the present invention, an angle adjustment plate that adjusts an amount of the object to be sorted entering each of the discharge passages may be provided at each of a top portion of a member that separates the first discharge passage and the third discharge passage, and a top portion of a member that separates the third discharge passage and the second discharge passage in the discharge hopper.

Here, in the present invention, the object to be sorted discharged from the third discharge passage is called "interlevel product".

Also, examples of the type of the object to be sorted in the present invention include non-defective products and defective products of the raw material, the raw material and foreign objects mixed therein, and types of granular objects when a plurality of granular objects are mixed into the raw material.

Advantageous Effects of the Invention

In the optical sorting machine according to the present invention, since the discharge hopper in the optical sorting unit has the third discharge passage formed between the first discharge passage provided at the falling position of the object to be sorted falling along the predetermined trajectory and the second discharge passage provided at the falling position of the object to be sorted removed from the predetermined falling trajectory, an object to be sorted caught when the object to be sorted is removed from the predetermined falling trajectory, and falling with the trajectory slightly changed can be discharged as an interlevel product from the third discharge passage of the discharge hopper.

Since the optical sorting machine according to the present invention includes the conveyance means that conveys the object to be sorted discharged from the third discharge passage of the discharge hopper to the storage means of the granular object feed unit, the interlevel product caught when the object to be sorted is removed can be sorted again in the optical sorting unit.

Consequently, in accordance with the optical sorting machine according to the present invention, for example, when the raw material is sorted into non-defective products and defective products, the interlevel products having a much higher mix rate of non-defective products than those of defective products discharged from the first discharge passage or the second discharge passage can be sorted again in the optical sorting unit, so that it is possible to improve the collection rate of non-defective products without increasing the size of the machine as compared to conventional cases.

Also, the optical sorting machine according to the present invention includes the plurality of granular object feed units as the granular object feed unit, the plurality of optical sorting units as the optical sorting unit, and the plurality of conveyance means as the conveyance means, the optical sorting machine further including: the conveyance means that conveys the object to be sorted discharged from the first discharge passage or the second discharge passage of the discharge hopper in the first optical sorting unit to the storage means of the second granular object feed unit; and the conveyance means that conveys the object to be sorted discharged from the first discharge passage or the second discharge passage of the discharge hopper in the second optical sorting unit to the storage means of the first granular object feed unit; in this case, for example, when the raw material is sorted into non-defective products and defective products, the objects to be sorted conveyed to the storage means of the second granular object feed unit and sorted into the defective products are reduced in amount as compared to a conventional optical sorting machine shown in FIG. 6, and processing capacity is left for the second optical sorting unit, so that the feed of the objects to be sorted in the first optical sorting unit can be increased and the non-defective products can be efficiently collected.

Moreover, in the optical sorting machine according to the present invention, the angle adjustment plate that adjusts the amount of the object to be sorted entering each of the discharge passages is provided at each of the top portion of the member that separates the first discharge passage and the third discharge passage, and the top portion of the member that separates the third discharge passage and the second discharge passage in the discharge hopper; in this case, for example, when the raw material is sorted into non-defective products and defective products, the purity of non-defective products discharged from the first discharge passage or the second discharge passage, and the mix rate of defective products in the interlevel products discharged from the third discharge passage can be adjusted.

DESCRIPTION OF EMBODIMENTS

Embodiments of the present invention will be drawings.

Figure 1:
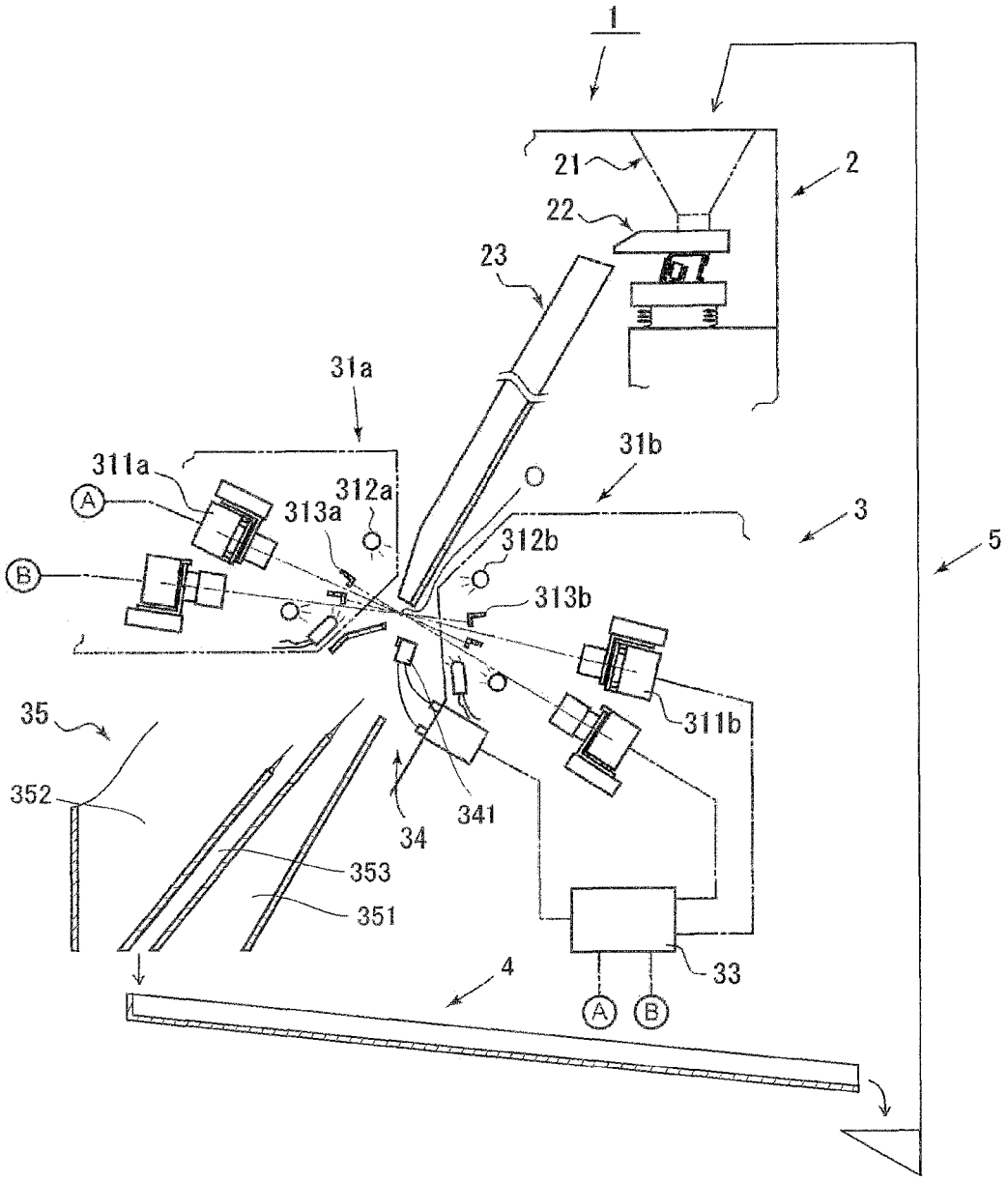
FIG. 1 is a side sectional view of the internal structure of an optical sorting machine according to an embodiment of the present invention.

FIG. 1 shows a side sectional view of the simplified internal structure of an optical sorting machine according to an embodiment of the present invention.

The optical sorting machine according to the present embodiment includes a granular object feed unit 2, an optical sorting unit 3, a gutter-like passage 4, and an elevator 5.

In the optical sorting machine according to the present embodiment, the granular object feed unit 2 includes a raw material tank 21, a vibrating feeder 22 that feeds granular objects stored in the raw material tank 21, and an inclined chute 23 with a predetermined width that causes the granular objects fed from the vibrating feeder 22 to flow down.

Here, the vibrating feeder 22 is placed on a vibration generating device having a vibrator or the like, and can control the feed of the granular objects to the inclined chute 23 by adjusting a frequency or a vibration in the vibration generating device.

Also, in the optical sorting machine according to the present embodiment, the optical sorting unit 3 includes a pair of optical detection sections 31*a* and 31*b* that are arranged ahead and behind a falling trajectory of the granular objects, a determination section 33 that determines the granular objects as non-defective products or defective products based on image pickup signals from the optical detection sections 31*a* and 31*b*, an ejector 34 that removes the defective products based on a determination result by the determination section 33 and thereby sorts the granular objects into the non-defective products and the defective products, and a discharge hopper 35 that discharges the granular objects sorted into the non-defective products and the defective products by the ejector 34.

The optical detection sections 31*a* and 31*b* can respond to a granular object released into the air in a state of spreading in a width direction from the lower end of the inclined chute 23, and includes image pickup means 311*a* and 311*b*, such as a CCD camera, that incorporate a line sensor or an area sensor such as a CCD and can receive light in a wavelength band of NIR (near infrared rays), visible light, ultraviolet rays or the like, illumination means 312*a* and 312*b*, such as a fluorescent lamp, a halogen lamp and an LED light source, that illuminate a detection position O on a predetermined falling trajectory of the granular object, and backgrounds 313*a* and 313*b*.

The optical detection sections 31*a* and 31*b* pick up the image of the granular object with the backgrounds 313*a* and 313*b* as background by use of the image pickup means 311*a* and 311*b* at the detection position 0.

The determination section 33 includes threshold setting means that sets a threshold value for separating the granular objects into non-defective products and defective products, and determination means that determines each granular object as a non-defective product or a defective product based on the threshold value. Here, the threshold value can be set as a value of a signal level for a light intensity or a color component in the image pickup signals of the granular objects picked up by the image pickup means 311*a* and 311*b*.

Based on the image pickup signal of each granular object transmitted from the optical detection sections 31*a* and 31*b*, the determination section 33 determines the granular object as a non-defective product or a defective product.

The ejector 34 can respond to a granular object released into the air in a state of spreading in a width direction from the lower end of the inclined chute 23 in a. similar manner to the optical detection sections 31*a* and 31*b*, and includes a nozzle 341 that can eject air selectively from a plurality of nozzle holes formed in the width direction.

The ejector 34 sorts the granular objects into non-defective products and defective products by ejecting air at a predetermined timing from a predetermined nozzle hole based on a signal for removing a defective product transmitted from the determination section 33, and thereby removing the defective product from the predetermined falling trajectory.

The discharge hopper 35 includes a first discharge passage 351 that discharges non-defective products falling along the predetermined falling trajectory, and a second discharge passage 352 that discharges defective products removed by the ejector 34 and falling with the falling trajectory changed.

The discharge hopper 35 also includes a third discharge passage 353 between the first discharge passage 351 and the second discharge passage 352.

Here, in the present invention, a granular object discharged from the third discharge passage 353 is called "interlevel product".

Moreover, the optical sorting machine according to the present embodiment includes the gutter-like passage 4 that conveys the interlevel product discharged from the third discharge passage 353, and the elevator 5 composed of a bucket conveyor or the like that conveys again the interlevel product conveyed through the gutter-like passage 4 to the raw material tank 21.

In the optical sorting machine 1 according to the present embodiment, the granular objects fed to the raw material tank 21 of the granular object feed unit 2 are conveyed to the inclined chute 23 via the vibrating feeder 22, naturally flow down in a serial manner in the state of spreading in the width direction through the inclined chute 23, and are thereafter released into the air along the predetermined falling trajectory from the lower end.

The images of the granular objects released into the air are picked up at the detection position O on the falling trajectory by the image pickup means 311*a* and 311*b* of the pair of optical detection sections 31*a* and 31*b* in the optical sorting unit 3.

Each granular object whose image is picked up by the image pickup means 311*a* and 311*b* is determined as a non-defective product or a defective product by comparing the signal level of the image pickup signal with the threshold value in the determination section 33.

The granular objects are sorted into non-defective products and defective products by ejecting air from the ejector 34 based on the removable signal transmitted from the determination section 33, and thereby removing the defective product from the predetermined falling trajectory, and are separately discharged from the first discharge passage 351 and the second discharge passage 352.

Although non-defective products existing near the removed defective product are caught in the air and fall with the trajectory slightly changed, the granular objects including many non-defective products caught in the air are discharged from the third discharge passage 353 as the interlevel products because of the third discharge passage 353 provided in the discharge hopper 35 between the first discharge passage 351 and the second discharge passage 352 in the present embodiment.

The interlevel products discharged from the third discharge gutter 353 are conveyed to the elevator 5 through the gutter-like passage 4, conveyed to the raw material tank 21 by the elevator 5, and sorted again into non-defective products and defective products in the optical sorting unit 3.

Figure 2:
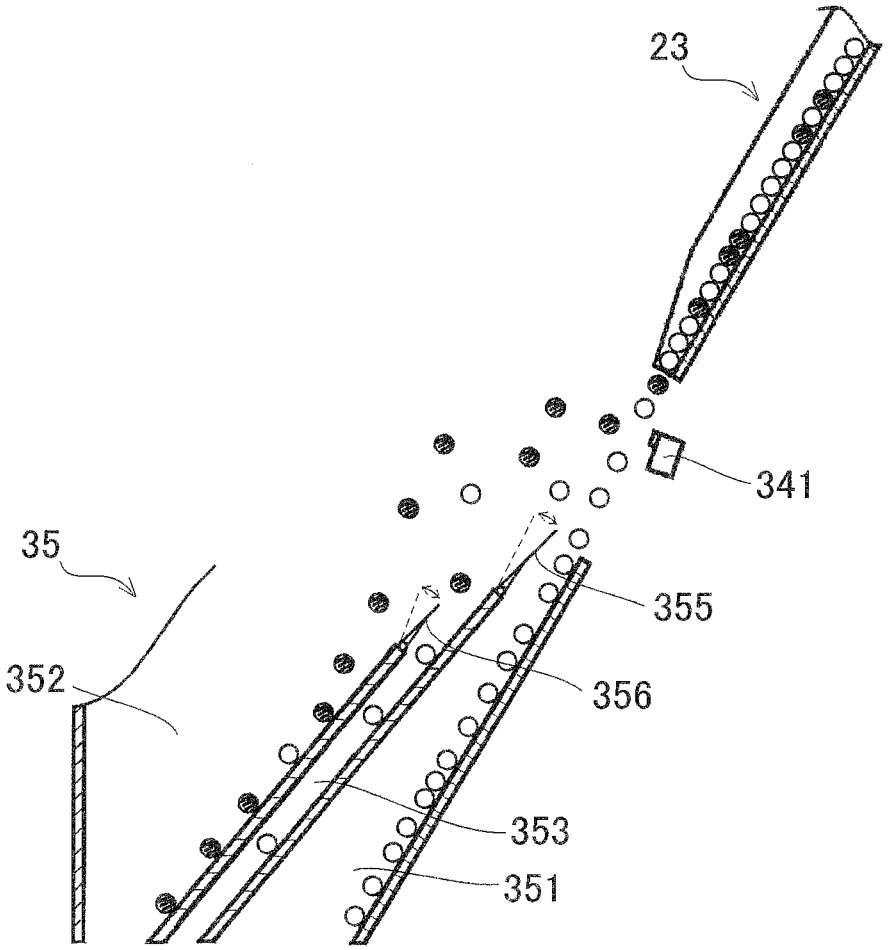
FIG. 2 is an explanatory view illustrating a sorting state in the optical sorting machine according to the embodiment of the present invention.

FIG. 2 shows an explanatory view of a case in which the granular objects are sorted into non-defective products and defective products in the optical sorting machine according to the present embodiment.

In the optical sorting machine according to the present embodiment, while the granular object flowing down through the inclined chute 23 and released into the air from the lower end is determined as a non-defective product or a defective product in the determination section of the optical sorting unit, the granular object determined as the non-defective product falls into the first discharge passage 351 along the predetermined falling trajectory.

Meanwhile, while the granular object determined as the defective product in the determination section is removed from the predetermined falling trajectory by the air ejected from the nozzle 341 of the ejector, some of the non-defective products existing around the removed defective product are caught therein, and fall with the trajectory slightly changed.

However, in the optical sorting machine according to the present embodiment, the discharge hopper 35 includes the third discharge passage 353 as shown in FIG. 2, so that most of the non-defective products caught in the air and falling with the trajectory slightly changed are discharged as the interlevel products separately from the defective product removed by the air.

Also, in the discharge hopper 35 according to the present embodiment, a first adjustment plate 355 is provided at a top portion of a separation member that separates the first discharge passage 351 and the third discharge passage 353, and a second adjustment plate 356 is provided at a top portion of a separation member that separates the second discharge passage 352 and the third discharge passage 353 so as to be manually or automatically changed in angle, respectively, as shown in FIG. 2.

The angles of the respective adjustment plates 355 and 356 can be automatically adjusted by automatically measuring the mix rate of the defective products in the non-defective products or the interlevel products by a well-known measuring instrument.

The purity of the non-defective products entering the first discharge passage 351 can be adjusted by changing the angle of the first adjustment plate 355.

The mix rate of the defective products in the interlevel products entering the third discharge passage 353 can be adjusted by changing the angle of the second adjustment plate 356.

The angle of the second adjustment plate 356 is preferably set such that the mix rate of the defective products in the interlevel products is equal to or less than the mix rate of the defective products in the raw material during operation of the optical sorting machine.

When the operation of the optical sorting machine is terminated, the granular objects can be prevented from remaining in the sorting machine by closing an upper opening of the third discharge passage by the second adjustment plate 356.

Figure 3:
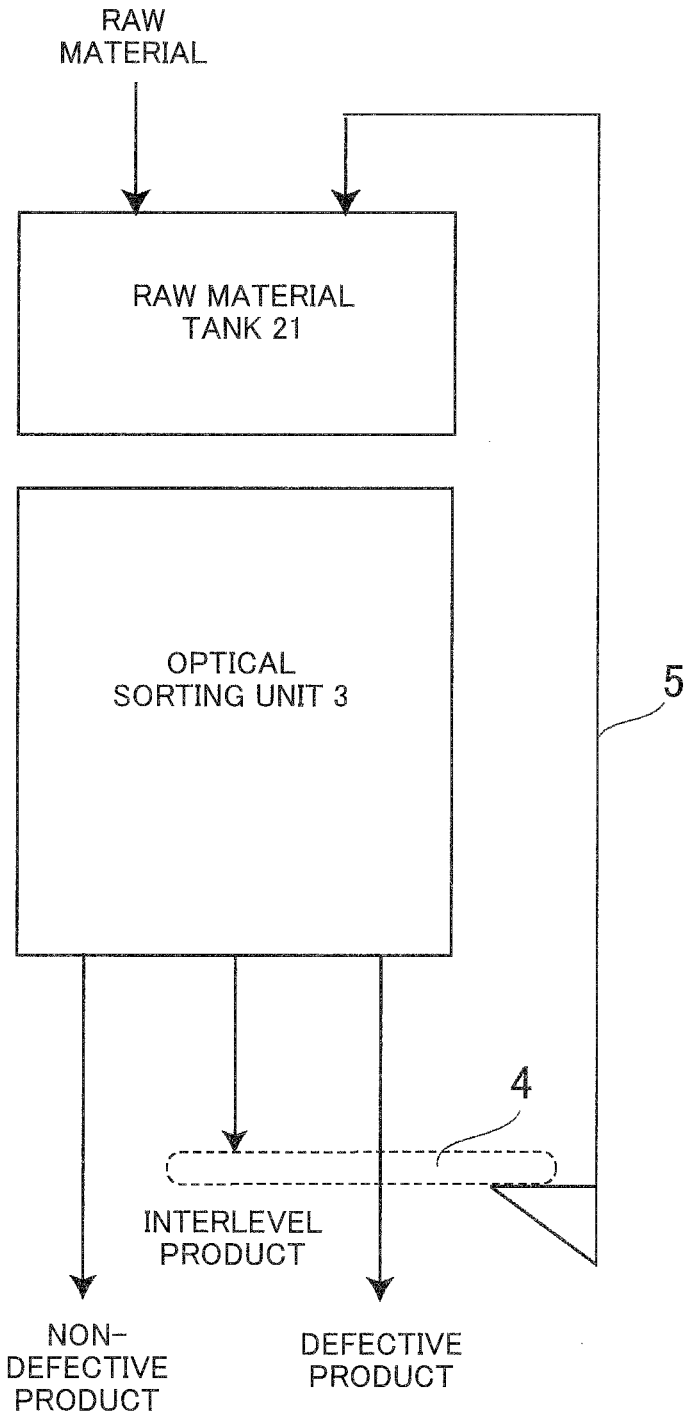
FIG. 3 is an explanatory view of a sorting procedure in the optical sorting machine according to the embodiment of the present invention.

FIG. 3 shows an explanatory view of a procedure for sorting the non-defective products and the defective products in the optical sorting machine according to the present embodiment.

In the optical sorting machine according to the present embodiment, the granular objects fed to the raw material tank 21 are sorted into non-defective products and defective products in the optical sorting unit 3. At this point, while the interlevel products including many non-defective products are generated in the optical sorting unit 3, the interlevel products are conveyed to the elevator 5 through the gutter-like passage 4, conveyed to the raw material tank 21 by the elevator 5, and sorted again into non-defective products and defective products in the optical sorting unit 3.

Consequently, the optical sorting machine according to the present embodiment can improve the collection rate of the non-defective products without increasing the size of the machine as compared to conventional cases.

<Another Embodiment of the Present Invention>

Figure 4:
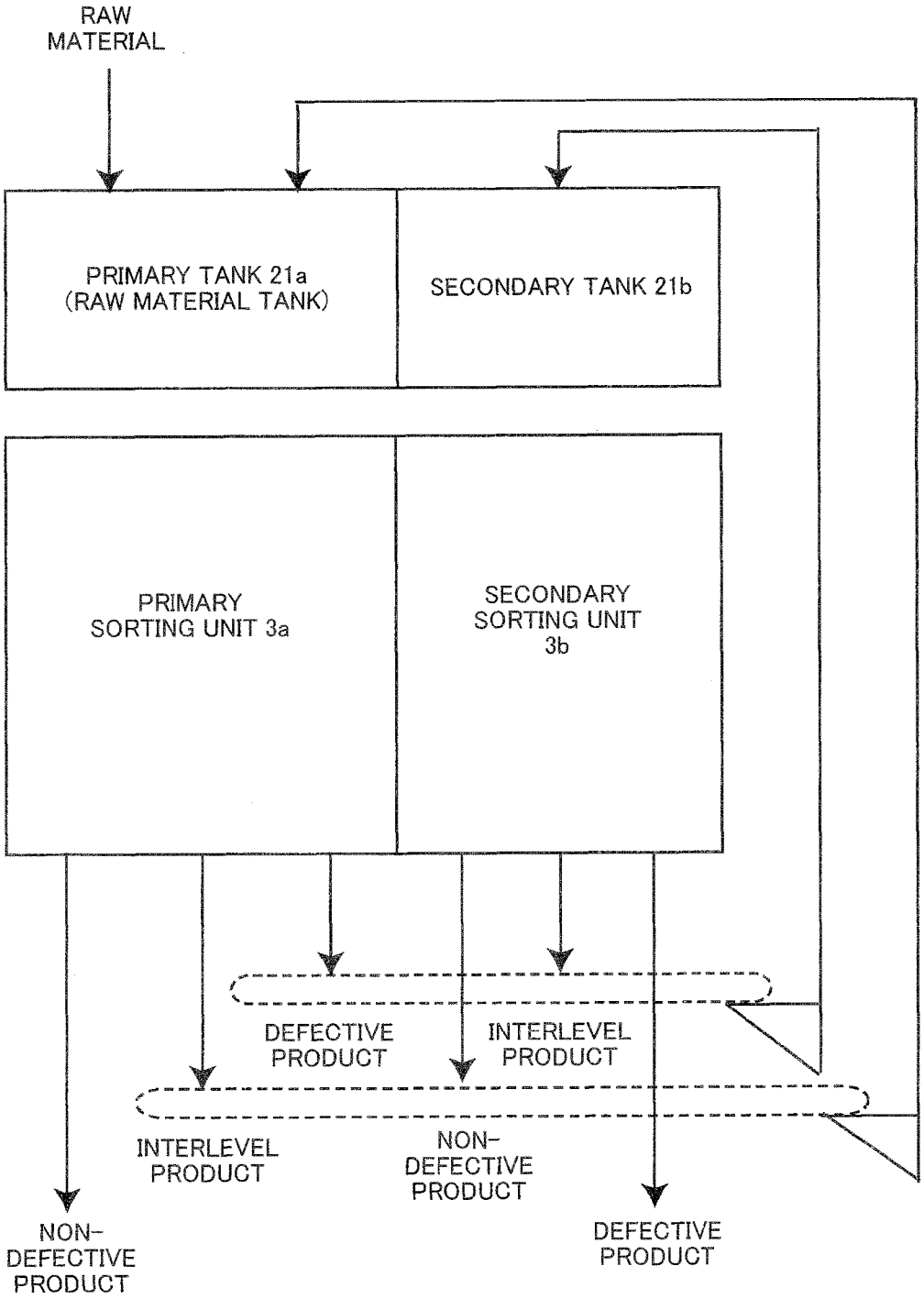
FIG. 4 is an explanatory view of a sorting procedure in an optical sorting machine according to another embodiment of the present invention.

FIG. 4 shows an explanatory view of a procedure for sorting non-defective products and defective products in an optical sorting machine according to another embodiment of the present invention.

The optical sorting machine according to the present embodiment sorts granular objects as a raw material into non-defective products and defective products in two stages by providing two sets of granular object feed units and optical sorting units in parallel.

The optical sorting machine according to the present embodiment includes a granular object feed unit, an optical sorting unit, a gutter-like passage, and an elevator having the same structures as those shown in FIG. 1.

In the optical sorting machine according to the present embodiment, granular objects fed to a primary tank 21*a* are first sorted into non-defective products and defective products in a primary sorting unit 3*a*. The granular objects sorted into the defective products in the primary sorting unit 3*a* are conveyed to a secondary tank 21*b*, and thereafter sorted into non-defective products and defective products in a secondary sorting unit 3*b*. The granular objects sorted into the non-defective products in the secondary sorting unit 3*b* are conveyed to the primary tank 21*a*, and sorted again into non-defective products and defective products in the unit 3*a*.

Meanwhile, in the optical sorting machine according to the present embodiment, interlevel products generated in the primary sorting unit 3*a* are conveyed to the primary tank 21*a*, and sorted again into non-defective products and defective products in the primary sorting unit 3*a*.

Also, interlevel products generated in the secondary sorting unit 3*b* are conveyed to the secondary tank 21*b*, and sorted again into non-defective products and defective products in the secondary sorting unit 3*b*.

Figure 6:
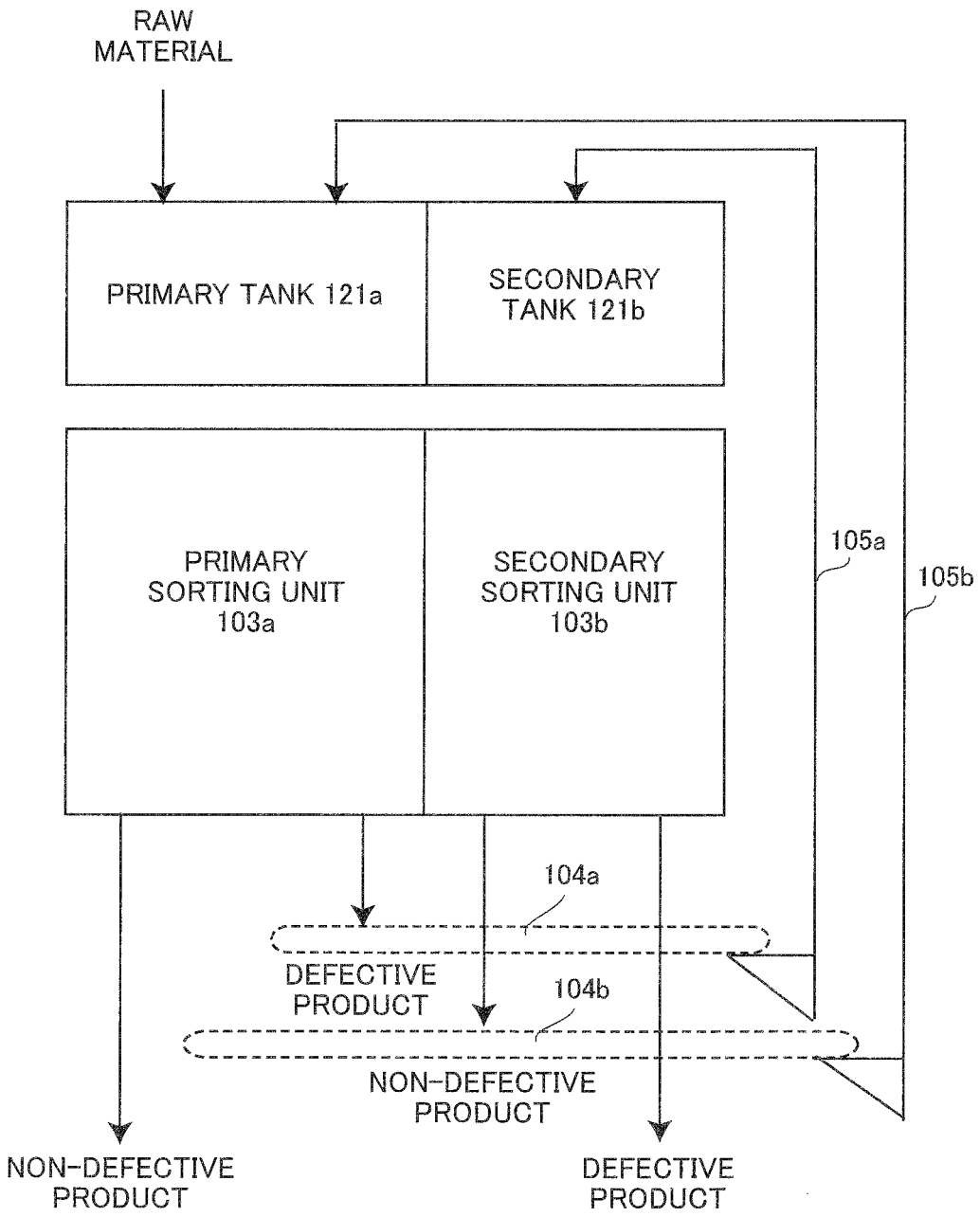
FIG. 6 is an explanatory view of a sorting procedure in a conventional optical sorting machine.

Accordingly, in the optical sorting machine according to the present embodiment, the granular objects sorted into the defective products to be conveyed to the secondary tank 21*b* are reduced in amount as compared to that in a conventional optical sorting machine shown in FIG. 6, and processing capacity is left for the secondary sorting unit 3*b*, so that the feed of the granular objects to the primary sorting unit 3*a* can be increased and the non-defective products can be efficiently collected.

Although the two sets of the granular object feed units and the optical sorting units are provided in parallel in the single optical sorting machine according to the present embodiment, two independent optical sorting machines may be connected together so as to sort the granular objects as the raw material into non-defective products and defective products in two stages <Yet Another Embodiment of the Present Invention>

Figure 5:
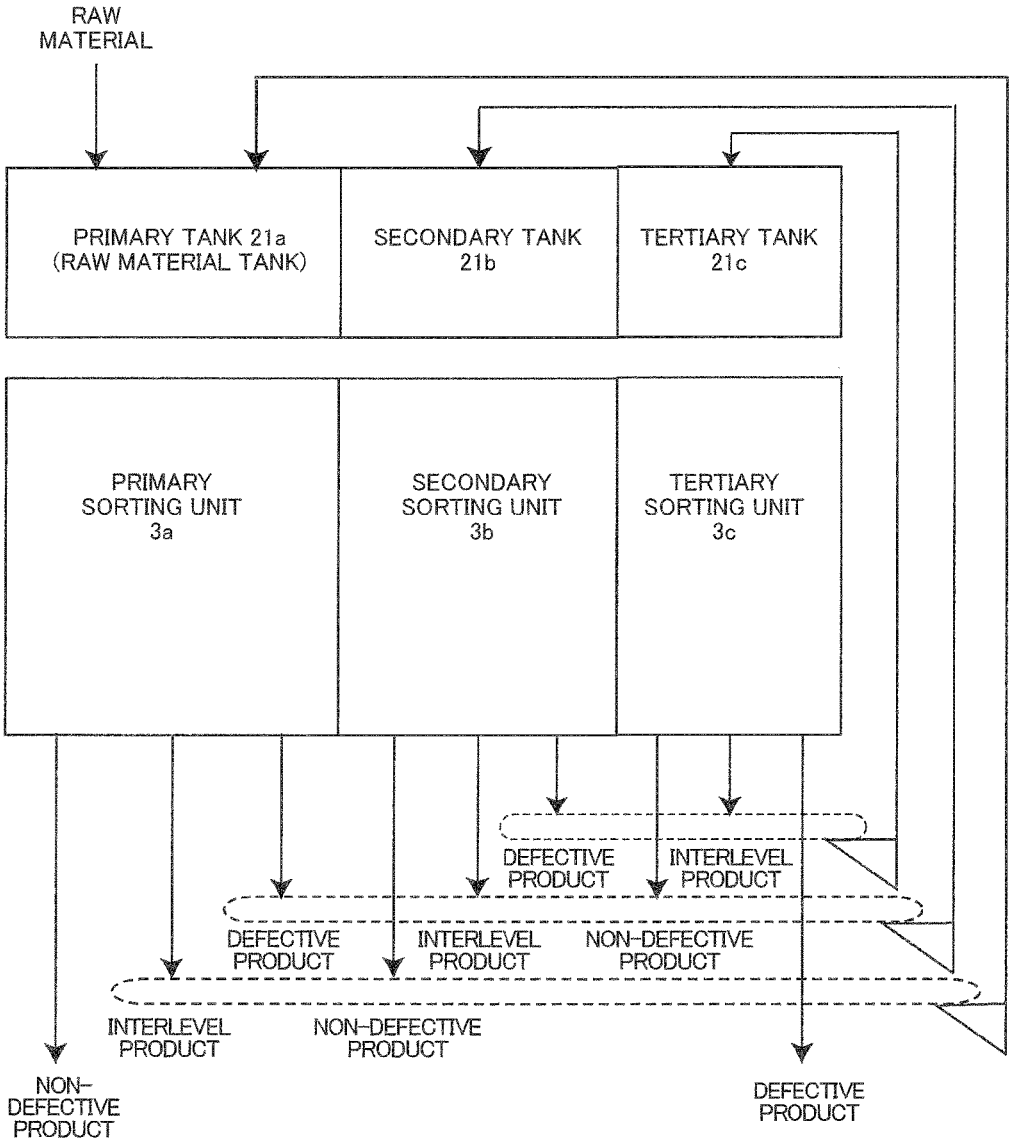
FIG. 5 is an explanatory view of a sorting procedure in an optical sorting machine according to yet another embodiment of the present invention.

FIG. 5 shows an explanatory view of a procedure for sorting non-defective products and defective products in an optical sorting machine according to yet another embodiment of the present invention.

The optical sorting machine according to the present embodiment sorts granular objects as a raw material into non-defective products and defective products in three stages by providing three sets of granular object feed units and optical sorting units in parallel, or by connecting three independent optical sorting machines.

The optical sorting machine according to the present embodiment also includes a granular object feed unit, an optical sorting unit, a gutter-like passage, and an elevator having the same structures as those shown in FIG. 1.

The optical sorting machine according to the present invention may sort the granular objects as the raw material into non-defective products and defective products in four or more stages by providing four or more sets of granular object feed units and optical sorting units in parallel, or by connecting four or more independent optical sorting machines.

<Other Embodiments>

Although it has been described that the optical sorting machine removes the defective products by the ejector in the aforementioned respective embodiments, the non-defective products may be also removed. When the granular objects as the raw material are sorted into non-defective products and defective products in a plurality of stages, the one with a lower mix rate into the raw material may be removed in the respective stages, so that the sorting efficiency is improved.

Although the granular object feed unit 2 includes the inclined chute 23 and the image pickup means 311*a* and 311*b* of the optical detection sections 31*a* and 31*b* pick up the image of the granular object released into the air from the lower end portion of the inclined chute 23 at the detection position O in the optical sorting machine according to the aforementioned respective embodiments, the image of a granular object released into the air from an end portion of a horizontally-arranged conveyor may be also picked up.

Although the nozzle that ejects air is used as the ejector so as to remove the granular objects from the predetermined falling trajectory in a non-contact manner in the optical sorting machine according to the aforementioned respective embodiments, mechanical means such as a leaf spring that uses a solenoid or the like as driving means may be used as the ejector so as to remove the granular objects. In this case, the defective products or the like can be appropriately removed by adjusting the driving amount or driving speed of the leaf spring.

In the optical sorting machine according to the aformentioned respective embodiments, the interlevel products discharged from the third discharge passage 353 may be conveyed to the elevator 5 by various conveyors such as a horizontal conveyor and a vibration conveyor instead of the gutter-like passage 4. A pneumatic pipe may be also arranged so as to directly pneumatically convey the interlevel products to the raw material tank 21.

Although the optical sorting machine according to the aforementioned respective embodiments sorts the granular objects as the raw material into the non-defective products and the defective products, the granular objects may be sorted into the raw material and foreign objects when the foreign objects are mixed into the raw material, or the granular objects may be sorted into one type and the other type when two or more types of granular objects are mixed into the raw material.

It goes without saying that the optical sorting machine according to the present invention is not limited to the aforementioned embodiments, and the configuration may be appropriately changed without departing from the scope of the present invention.

INDUSTRIAL APPLICABILITY

The optical sorting machine according to the present invention can improve the collection rate of the non-defective products without increasing the size of the machine, and is thus extremely useful.

REFERENCE SIGN LIST

1 Optical sorting machine
2 Granular object feed unit
21 Raw material tank
22 Vibrating feeder
23 Chute
3 Optical sorting unit
31*a*, 31*b* Optical detection section
311*a*, 311*b* Image pickup means
312*a*, 312*b* Illumination means
313*a*, 313*b* Background
33 Determination section
34 Ejector
35 Discharge hopper
351 First discharge passage
352 Second discharge passage
353 Third discharge passage
355 First adjustment plate
356 Second adjustment plate
4 Gutter-like passage
5 Elevator

The invention claimed is:

1. An optical sorting machine comprising:

a first granular object feed unit including first storage means that stores a raw material fed from outside the sorting machine as an object to be sorted, and first transfer means that transfers the object to be sorted from the first storage means;

a first optical sorting unit including:

first optical detection means that detects an object to be sorted falling along a predetermined trajectory from an end portion of the first transfer means, first determination means that determines a type of the object to be sorted based on a detection signal from the first optical detection means, a first ejector that removes an object to be sorted determined as a specific type from the predetermined falling trajectory based on a determination result provided by the first determination means, and a first discharge hopper having a first discharge passage provided at a falling position of the object to be sorted falling along the predetermined trajectory as a non-defective product, a second discharge passage provided at a falling position of the object to be sorted removed from the predetermined falling trajectory as a defective product, and a third discharge passage, formed between the first discharge passage and the second discharge passage, through which an object to be sorted located near and mixed in with the defective product when the non-defective product and the defective product are removed from the raw material and whose trajectory has been slightly changed is discharged as an interlevel product; and first conveyance means that returns an object to be sorted discharged as an interlevel product from the third discharge passage of the first discharge hopper in the first optical sorting unit to the first storage means of the first granular object feed unit to enable the object to be re-sorted by the first optical sorting unit, wherein the first discharge passage, the second discharge passage, and the third discharge passage are contiguous with and parallel to each other, and lie in a single distal-proximal plane, the optical sorting machine further comprising:

a second granular object feed unit including a second storage means into which the object discharged as defective product from the second discharge passage of the first discharge hopper in the first optical sorting unit is delivered and stored, and a second transfer means that transfers the object to be sorted from the second storage means, a second optical sorting unit including a second optical detection means that detects an object to be sorted falling along a predetermined trajectory from an end portion of the second transfer means, a second determination means that determines a type of the object to be sorted based on a detection signal from the second optical detection means, a second ejector that removes an object to be sorted determined as a specific type from the predetermined falling trajectory based on a determination result provided by the second determination means, a second discharge hopper having a first discharge passage provided at a falling position of the object to be sorted falling along the predetermined trajectory as a non-defective product, a second discharge passage provided at a falling position of the object to be sorted removed from the predetermined falling trajectory as a defective product, and a third discharge passage, formed between the first discharge passage and the second discharge passage, through which an object to be sorted located near and mixed in with the defective product when the non-defective product and the defective product are removed from the raw material sorted once as the defective product and whose trajectory has been slightly changed including a defective product and a non-defective product is discharged is passed as an interlevel product, and second conveyance means that returns an object to be sorted discharged as an interlevel product from the third discharge passage of the second discharge hopper in the second optical sorting unit to the second storage means of a second granular object feed unit to enable the object to be re-sorted by the second optical sorting unit, wherein the second conveyance means conveys an object to be sorted discharged as defective product from the second discharge passage of the first discharge hopper in the first optical sorting unit to the second storage means of the second granular object feed unit, wherein the first conveyance means conveys an object to be sorted discharged as non-defective product from the first discharge passage of the second discharge hopper of the second optical sorting unit to the first storage means of the first granular object feed unit.

* * * * *